US008864513B2

(12) United States Patent
Yamamoto et al.

(10) Patent No.: US 8,864,513 B2
(45) Date of Patent: Oct. 21, 2014

(54) TERMINAL FOR ENERGIZATION

(75) Inventors: Akira Yamamoto, Miyoshi (JP); Shigeo Hirashima, Nagoya (JP)

(73) Assignees: Toyota Jidosha Kabushiki Kaisha, Toyota-shi (JP); Denso Corporation, Kariya-shi (JP)

( * ) Notice: Subject to any disclaimer, the term of this patent is extended or adjusted under 35 U.S.C. 154(b) by 109 days.

(21) Appl. No.: 13/555,826

(22) Filed: Jul. 23, 2012

(65) Prior Publication Data

US 2013/0029517 A1 Jan. 31, 2013

(30) Foreign Application Priority Data

Jul. 25, 2011 (JP) ..... 2011-162045

(51) Int. Cl.

| | |
|---|---|
| ***H01R 13/62*** | (2006.01) |
| ***H01R 13/74*** | (2006.01) |
| ***H01R 13/10*** | (2006.01) |
| ***H01R 13/04*** | (2006.01) |

(52) U.S. Cl.

CPC ..... *H01R 13/04* (2013.01); *H01R 13/748* (2013.01); *H01R 13/10* (2013.01)

USPC ..... 439/296

(58) Field of Classification Search

USPC ..... 439/391, 372, 587, 262–263, 284, 74, 439/259, 296

See application file for complete search history.

(56) References Cited

U.S. PATENT DOCUMENTS

| | | | | |
|---|---|---|---|---|
| 7,955,110 | B1 * | 6/2011 | Kataoka et al. | 439/284 |
| 8,226,429 | B2 * | 7/2012 | Umetsu et al. | 439/262 |
| 2006/0281352 | A1 | 12/2006 | Kabasawa et al. | |
| 2011/0159717 | A1 | 6/2011 | Umetsu et al. | |
| 2011/0159729 | A1 * | 6/2011 | Suzuki et al. | 439/587 |
| 2011/0189883 | A1 * | 8/2011 | Suzuki et al. | 439/372 |

FOREIGN PATENT DOCUMENTS

| | | |
|---|---|---|
| CN | 102110923 A | 6/2011 |
| JP | 06150989 A | 5/1994 |
| JP | 08096866 A | 4/1996 |
| JP | 2011-108633 A | 6/2011 |

* cited by examiner

*Primary Examiner* — Jean F Duverne

(74) *Attorney, Agent, or Firm* — Gifford, Krass, Sprinkle, Anderson & Citkowski, P.C.

(57) ABSTRACT

A terminal for conduction includes an insulating member that is fixed to a housing and that includes a flange portion that extends along the housing; a first terminal member that is provided to penetrate through the insulating member and that includes a tubular portion, the first terminal member being conductive; and a second terminal member that includes an engagement portion and that is inserted into the tubular portion of the first terminal member, the second terminal member being fixed to the first terminal member through the engagement portion in the tubular portion and extending in an axial direction of the tubular portion. The engagement portion is positioned in a space between one surface and the other surface of the flange portion in the axial direction.

12 Claims, 3 Drawing Sheets

TERMINAL FOR ENERGIZATION

CROSS REFERENCE TO RELATED APPLICATIONS

This application claims priority to Japanese Patent Application No. 2011-162045 filed on Jul. 25, 2011, which is incorporated herein by reference in its entirety including the specification, drawings and abstract.

BACKGROUND OF THE INVENTION

1. Field of the Invention

The present invention relates to a terminal for energization, and more particularly to a terminal for energization in which two terminal members for energization are engaged with each other through an engagement portion.

2. Description of Related Art

Japanese Patent Application Publication No. 8-96866 (JP-8-96866-A) and Japanese Patent Application Publication No. 6-150989 (JP-6-150989-A), for example, disclose a terminal.

JP-8-96866-A discloses a bush for a stud bolt terminal. The bush is provided at the outer periphery of the stud bolt terminal, and includes a groove portion that opens upward with the stud bolt terminal standing upright. The groove portion of the bush is provided with a guide surface that is provided on the opening side of the groove portion and that is inclined in the direction of widening the opening to guide a lug portion of a plate terminal into the groove portion to fasten the plate terminal to the stud bolt terminal for conduction. The lug portion is inserted into the groove portion from above so as to restrict movement of the plate terminal.

JP-6-150989-A discloses a structure that includes a bolt portion in which a bolt that serves as a terminal for electrical connection is fixed to a flat plate portion, and a boss portion in which a slot portion for insertion of the flat plate portion and a guide portion that guides the bolt to a through hole are formed. The flat plate portion is inserted into the slot portion, and the bolt is fitted into the guide portion to be pushed into the through hole, so that a bus bar or a connection terminal is fitted from the through hole to be fastened by a nut.

SUMMARY OF THE INVENTION

When a terminal member is provided with an engagement portion, the engagement portion may be subjected to a large stress to be cracked. The present invention provides a terminal for conduction that can prevent cracking at the engagement portion.

An aspect of the present invention is directed to a terminal for conduction. The terminal for conduction includes an insulating member that is fixed to a housing and that includes a flange portion that extends along the housing; a first terminal member that is provided to penetrate through the insulating member and that includes a tubular portion, the first terminal member being conductive; and a second terminal member that includes an engagement portion and that is inserted into the tubular portion of the first terminal member, the second terminal member being fixed to the first terminal member through the engagement portion in the tubular portion and extending in an axial direction of the tubular portion. The engagement portion is positioned in a space between a plane including one surface of the flange portion and a plane including the other surface of the flange portion in the axial direction.

In the thus configured terminal for conduction, the engagement portion is positioned within the thickness of the flange portion. Therefore, a stress produced at the engagement portion can be relieved because the engagement portion is surrounded by the flange portion.

In the terminal for conduction, the first terminal member may include a projecting portion that projects in a radial direction of the tubular portion, the projecting portion being provided in the space.

In the terminal for conduction, the second terminal member may be a stud bolt.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
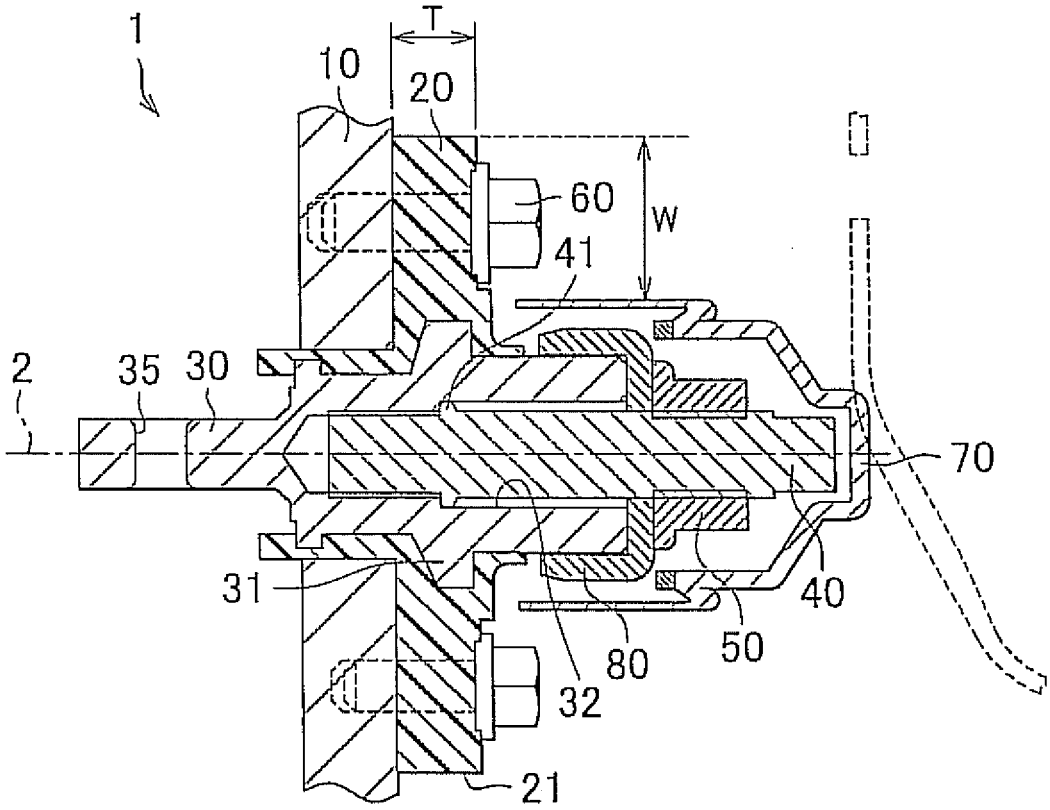
FIG. 1 is a cross-sectional view of a terminal for conduction that penetrates through a housing according to a first embodiment of the present invention.

Embodiments of the present invention will be described below with reference to the drawings. The same or equivalent portions of the following embodiments are denoted by the same reference numerals, and are not described repeatedly. The embodiments may be combined with each other.

(First Embodiment)

FIG. 1 is a cross-sectional view of a terminal for conduction that penetrates through a housing according to a first embodiment of the present invention. As shown in FIG. 1, a terminal for conduction 1 according to the first embodiment of the present invention includes an insulating member for fixation 20, a first terminal member 30, and a second terminal member 40. The insulating member for fixation 20 is fixed to a housing 10, and includes a flange portion 21 that extends along the housing 10 and that has a thickness T. The first terminal member 30 is provided to penetrate through the insulating member for fixation 20, and includes a tubular portion 32 that extends in the axial direction (direction of penetration) which is indicated by an arrow 2. The second terminal member 40 includes an engagement portion 41, and is inserted into the tubular portion 32 of the first terminal member 30. The second terminal member 40 is fixed to the first terminal member 30 through the engagement portion 41 in the tubular portion 32. The engagement portion 41 is positioned within the thickness T of the flange portion 21 in the axial direction which is indicated by the arrow 2. That is, an axial position of the engagement portion is between an axial position of one surface of the flange portion and an axial position of the other surface of the flange portion (or the engagement portion 41 is positioned in a space between a plane including one surface of the flange portion 21 and a plane including the other surface of the flange portion 21 in the axial direction which is indicated by the arrow 2). In the first embodiment, the axial direction which is indicated by the arrow 2 is perpendicular to the surfaces of the flange portion 21.

The housing 10 houses an electric device such as an inverter, a converter, and a capacitor. For example, a DC-DC (direct current-direct current) converter that supplies a current to an accessory of a vehicle is housed in the housing 10.

Therefore, it is necessary to secure conduction between the electric device inside the housing 10 and the outside of the housing 10. The terminal for conduction 1 is used for conduction between the inside and the outside of the housing 10.

The insulating member for fixation 20 is formed by a resin for fixation. The insulating member for fixation 20 includes the flange portion 21 which extends along the housing 10. A bolt 60 is provided to penetrate through the flange portion 21. The insulating member for fixation 20 is fixed to the housing 10 with the bolt 60 penetrating through the insulating member for fixation 20 and with the distal end portion of the bolt 60 screwed into the housing 10.

The first terminal member 30 is provided to penetrate through the insulating member for fixation 20. The first terminal member 30 includes an opening 35 provided inside the housing 10. A bolt or the like is inserted into the opening 35 to connect the first terminal member 30 to the electric device inside the housing 10.

The first terminal member 30, which serves as an energized terminal portion, includes the tubular portion 32 which extends in the axial direction which indicated by the arrow 2. In FIG. 1, the tubular portion 32 is shaped to have a bottom. However, the tubular portion 32 is not necessary shaped to have a bottom, and may be provided to penetrate through the first terminal member 30.

A projecting portion 31 is provided on the outer peripheral surface of the first terminal member 30. The projecting portion 31 may be provided over the entire outer periphery (or over the entire circumference) of the first terminal member 30. A plurality of projecting portions 31 may be provided to be disposed radially on the circumference at intervals from each other.

Providing the projecting portion 31 can increase the area of contact between the outer peripheral surface of the first terminal member 30 and the insulating member for fixation 20. In addition, providing the projecting portion 31 within the thickness T can reliably secure the projecting portion 31 and the insulating member for fixation 20 to each other.

The second terminal member 40, which is formed by a stud bolt, is partially inserted into the tubular portion 32 so that the engagement portion 41 is engaged with the tubular portion 32 to prevent rotation of the second terminal member 40. The second terminal member 40 extends in the axial direction of the tubular portion 32.

The engagement portion 41 is positioned within the thickness T of the flange portion 21 of the insulating member for fixation 20 in the axial direction, and also positioned within the projecting portion 31 in the axial direction (disposed such that the entire engagement portion 41 overlaps the projecting portion 31 in the radial direction of the tubular portion 32). This prevents cracking due to a stress produced at the engagement portion 41 because the first terminal member 30 and the flange portion 21 are thick along the radial direction of the engagement portion 41.

In the example, the second terminal member 40 is a stud bolt (insertion bolt). However, the present invention is not limited thereto, and the second terminal member 40 may be an element other than a bolt as long as it includes the engagement portion 41. A round terminal 80 is fitted with the second terminal member 40. A nut 50 is screwed onto the second terminal member 40 to press the round terminal 80 to bring the round terminal 80 into tight contact with the first terminal member 30. This allows the round terminal 80 and the first terminal member 30 to contact each other.

It is necessary that the first terminal member 30 should be a conductive member. However, the second terminal member 40 may be a conductive member or an insulating member. This is because conduction between the inside and the outside of the housing 10 can be achieved by conduction between the round terminal 80 and the first terminal member 30 in the example. In the case where the second terminal member 40 is not a stud bolt, the round terminal 80 may be secured to the first terminal member 30 by means other than screwing to achieve conduction between the first terminal member 30 and the round terminal 80. The round terminal 80 is not necessarily round (circular as seen in the axial direction), and may be a conductive terminal that is structured to contact the first terminal member 30.

The thus configured terminal for conduction 1 according to the first embodiment can reduce a stress produced during engagement at the engagement portion 41 without increasing the physical size of the terminal for conduction 1. This is because it is possible to increase the volume of the first terminal member 30 by providing the flange portion 21 of the insulating member for fixation 20 in a dead space, without increasing the physical size of the entire terminal for conduction 1.

That is, the engagement portion 41 is surrounded by other members, and therefore subjected to a small stress compared to the related art. As a result, cracking of the first terminal member 30 around the engagement portion 41 can be prevented.

(Second Embodiment)

Figure 2:
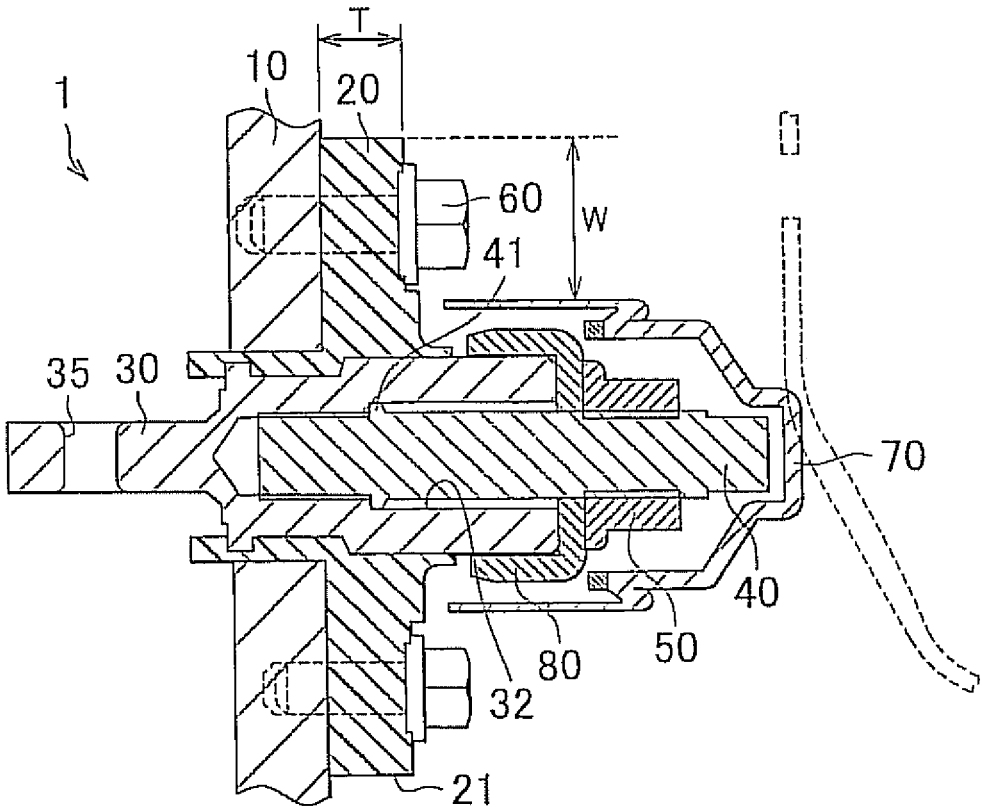
FIG. 2 is a cross-sectional view of a terminal for conduction that penetrates through a housing according to a second embodiment of the present invention.

FIG. 2 is a cross-sectional view of a terminal for conduction that penetrates through a housing according to a second embodiment of the present invention. As shown in FIG. 2, the configuration according to the second embodiment is different from the configuration according to the first embodiment in that no projecting portion 31 is provided. The terminal for conduction according to the second embodiment can also achieve the same effect as that of the terminal for conduction 1 according to the first embodiment.

Figure 3:
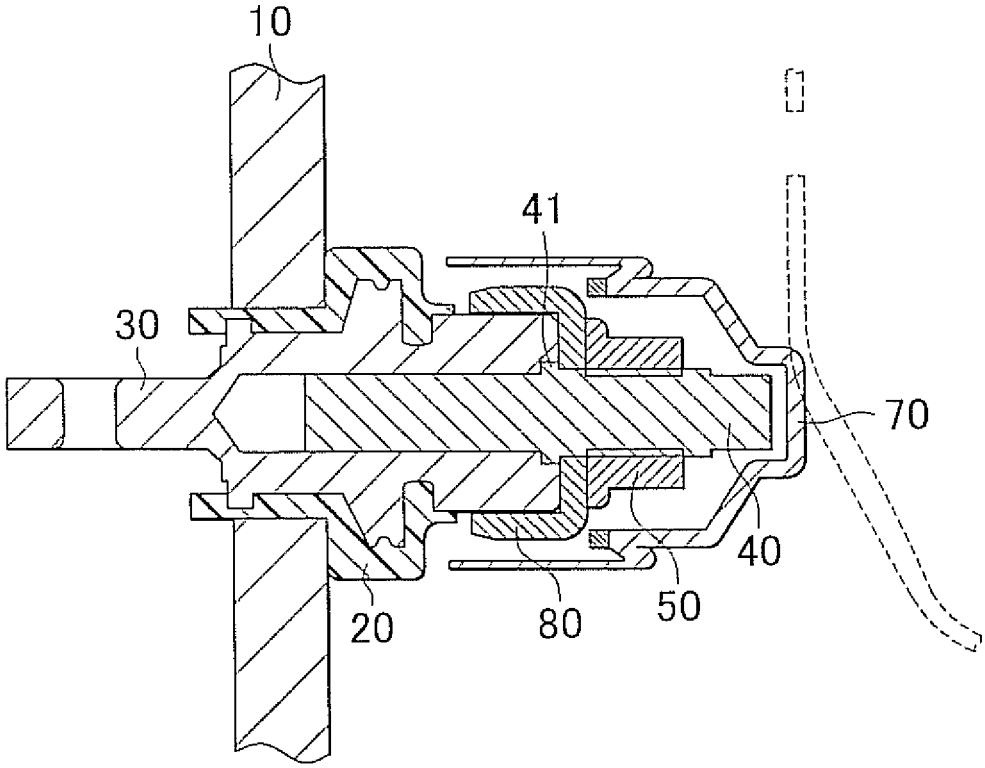
FIG. 3 shows a configuration according to comparative examples in which no engagement portion is provided within the thickness of a flange portion.

FIG. 3 shows a configuration according to the comparative examples in which no engagement portion is provided within the thickness of a flange portion. In the configuration according to the comparative examples, as shown in FIG. 3, the engagement portion 41 is disposed away from the insulating member for fixation 20. The round terminal 80, the nut 50, and the second terminal member 40 are covered by a cover 70.

In the configuration which is shown in FIG. 3, it is difficult for other members to receive a stress produced at the engagement portion 41, which tends to increase the physical size.

In FIG. 1, it is possible to secure a sufficient clearance W for insertion of a tool that is used to fasten the bolt 60. The clearance W can be secured because it is not necessary to provide a thick portion corresponding to the engagement portion 41 since the engagement portion 41 is provided within the thickness T of the flange portion 21, or even if it is necessary to provide a thick portion, such a thick portion can be provided inside the flange portion 21.

It should be considered that the embodiments disclosed herein are illustrative in all respects and not limiting. The scope of the present invention is intended to be defined not by the above description of the embodiments but by the claims, and to include all equivalents and modifications that fall within the scope of the claims.

What claimed is:

1. A terminal for conduction comprising:

an insulating member that is fixed to a housing and that includes a flange portion that extends along the housing;

a first terminal member that is provided to penetrate through the insulating member and that includes a tubular portion, the first terminal member being conductive; and a second terminal member that includes an engagement portion and that is inserted into the tubular portion of the first terminal member, the second terminal member being fixed to the first terminal member through the engagement portion in the tubular portion and extending in an axial direction of the tubular portion, wherein the engagement portion is positioned in a space between a plane including one surface of the flange portion and a plane including the other surface of the flange portion in the axial direction.

2. The terminal for conduction according to claim 1, wherein the first terminal member includes a projecting portion that projects in a radial direction of the tubular portion, the projecting portion being provided in the space.

3. The terminal for conduction according to claim 2, wherein the engagement portion is disposed so as to overlap the projecting portion in the radial direction of the tubular portion.

4. The terminal for conduction according to claim 1, wherein the second terminal member is a stud bolt.

5. The terminal for conduction according to claim 2, wherein the second terminal member is a stud bolt.

6. The terminal for conduction according to claim 3, wherein the second terminal member is a stud bolt.

7. A terminal for conduction comprising:

a housing having an exterior surface;

an insulating member that is fixed to the housing, the insulating member includes a generally planar flange portion having a first planar surface and a spaced apart second planar surface defining a thickness, the first planar surface extending along the exterior surface of the housing;

a first terminal member that is provided to penetrate through the insulating member and that includes a tubular portion, the first terminal member being conductive; and a second terminal member that includes an engagement portion and that is inserted into the tubular portion of the first terminal member, the second terminal member being fixed to the first terminal member through the engagement portion in the tubular portion and extending in an axial direction of the tubular portion, wherein the engagement portion is positioned within the thickness of the generally planar flange portion.

8. The terminal for conduction according to claim 7, wherein the first terminal member includes a projecting portion that projects in a radial direction of the tubular portion, the projecting portion being provided in the thickness of the generally planar flange portion.

9. The terminal for conduction according to claim 8, wherein the engagement portion is disposed so as to overlap the projecting portion in the radial direction of the tubular portion.

10. The terminal for conduction according to claim 7, wherein the second terminal member is a stud bolt.

11. The terminal for conduction according to claim 8, wherein the second terminal member is a stud bolt.

12. The terminal for conduction according to claim 9, wherein the second terminal member is a stud bolt.

* * * * *